US005181831A

United States Patent [19]

Teraya

[11] Patent Number: 5,181,831

[45] Date of Patent: Jan. 26, 1993

[54] VARIABLE CAPACITY WOBBLE PLATE COMPRESSOR

[75] Inventor: Takanori Teraya, Konan, Japan

[73] Assignee: Zexel Corporation, Tokyo, Japan

[21] Appl. No.: 885,318

[22] Filed: May 18, 1992

[30] Foreign Application Priority Data

May 22, 1991 [JP] Japan ..... 3-45937[U]

[51] Int. Cl.[5] ..... F04B 25/04

[52] U.S. Cl. ..... 417/222 S; 417/270

[58] Field of Search ..... 417/222 R, 222 S, 269, 417/270; 92/12.2, 71

[56] References Cited

U.S. PATENT DOCUMENTS 5,026,316 6/1991 Kurosawa et al. ..... 417/222 S

*Primary Examiner*—Leonard E. Smith

*Attorney, Agent, or Firm*—Frishauf, Holtz, Goodman & Woodward

[57] ABSTRACT

A variable capacity wobble plate compressor including a cylinder block, the cylinder block having a plurality of cylinders formed therein and a bearing-receiving hole formed therethrough, bearings received within the bearing-receiving hole, a discharging space defined on one side of the cylinder block, a crankcase defined on the other side of the cylinder block, a wobble plate accommodated within the crankcase and mounted on a drive shaft, a plurality of outlet ports communicating between respective ones of the cylinders and the discharging space, discharge valve means having a plurality of valve elements for closing and opening respective ones of the outlet ports, and a fixing member securing the discharge valve means to the cylinder block at the one side thereof, wherein the fixing member has a high pressure-introducing passage formed therethrough for introducing high-pressure refrigerant gas within the discharging space to the bearing-receiving hole, and then into the crankcase. The high pressure-introducing passage comprises a bore formed therein and extending from the head to the front end, and a restriction bore formed through the front end, the restriction bore opening into the bearing-receiving hole.

2 Claims, 3 Drawing Sheets

VARIABLE CAPACITY WOBBLE PLATE COMPRESSOR

BACKGROUND OF THE INVENTION

This invention relates to a variable capacity wobble plate compressor for compressing refrigerant circulated in an air conditioner for automotive vehicles, etc.

A conventional variable capacity wobble plate compressor of this kind has been proposed e.g. by Japanese Provisional Utility Model Registration Application (Kokai) No. 2-141682, which comprises a cylinder block having a plurality of cylinders formed therein and a bearing-receiving hole formed therethrough, a discharging space defined on one side of the cylinder block, a crankcase defined on the other side of same, a drive shaft having one end thereof supported by a bearing received in the bearing-receiving hole of the cylinder block, a wobble plate accommodated within the crankcase and fitted on the drive shaft, discharge valve means having a plurality of discharge valve elements for opening and closing respective outlet ports which communicate the cylinders with the discharging space, a fixing bolt fixing the discharge valve means to an end face of the cylinder block on the one side thereof, and capacity control means for changing pressure within the crankcase to thereby control the capacity or delivery quantity of the compressor, wherein the fixing bolt is formed therethrough with a high pressure-introducing passage for introducing high-pressure refrigerant gas within the discharging space into the bearing-receiving hole, whereby the high-pressure refrigerant gas introduced into the bearing-receiving hole is allowed to flow into the crankcase.

In the proposed variable capacity wobble plate compressor, the high pressure-introducing passage is provided for the purpose of introducing high pressure from the discharging chamber into the crankcase to thereby assist building-up of the pressure within the crankcase by blow-by gas (high-pressure refrigerant gas leaking through clearances between the cylinders and pistons sliding within the cylinders).

As shown in FIG. 1, the fixing bolt 300 used in the above compressor is formed therethrough with a high pressure-introducing passage consisting of a hexagon socket 301 formed in a head thereof, a medium diameter bore 302 continuous to the hexagon socket 301 and having a bore diameter A (e.g. A=3 mm), a restriction bore 303 having a bore diameter B (e.g. B=0.4 mm), and another medium diameter bore 304 having the same bore diameter as the first-mentioned medium diameter bore 302.

In general, in the conventional variable capacity wobble plate compressor described above, it is desirable to sufficiently cool and lubricate bearings used therein, especially a radial bearing and a thrust bearing in the bearing-receiving hole of the cylinder block.

According to the above compressor, in which the restriction bore 303 is provided in an intermediate portion of the high pressure-introducing passage formed though the fixing bolt 300, the high-pressure refrigerant gas introduced from the discharging chamber undergoes adiabatic expansion to fall in temperature upon entering the medium diameter bore 304 through the restriction bore 303. However, the ratio of expansion of the gas is only 7.5 (i.e. A (3 mm)/B (0.4 mm)), and accordingly the temperature falling amount is not so large. As a result, the high-pressure refrigerant gas from the discharging space is introduced to the bearings within the cylinder block without being much lowered in temperature while passing through the high pressure-introducing passage. Therefore, the bearings cannot be sufficiently cooled by the high-pressure refrigerant gas from the discharging space.

Further, in the conventional variable capacity wobble plate compressor, the restriction bore 303 is provided at an intermediate portion of the high pressure-introducing passage formed through the fixing bolt 300. Therefore, in machining the high pressure-introducing passage through the fixing bolt 300, it is required to effect boring of the fixing bolt two times, i.e. form the medium diameter bore 302 on one side of a wall through which the restriction bore 303 is formed and form the medium diameter bore 304 on the other side of the wall. This increases the number of machining steps of the fixing bolt, which results in an increased manufacturing cost.

SUMMARY OF THE INVENTION

It is an object of the invention to provide a variable capacity wobble plate compressor which has improved contribution of a high-pressure refrigerant gas from a discharging space to cooling of bearings received within a bearing-receiving hole formed through the cylinder block to thereby prolong the lives of the bearings.

Another object of the invention is to enable a member fixing discharge valve means to a side block to be manufactured at a reduced cost.

To attain the above objects, the present invention provides a variable capacity wobble plate compressor including a cylinder block, the cylinder block having a plurality of cylinders formed therein and a bearing-receiving hole formed therethrough, bearings received within the bearing-receiving hole, a discharging space defined on one side of the cylinder block, a crankcase defined on the other side of the cylinder block, a drive shaft having one end thereof supported by the bearings within the bearing-receiving hole, a wobble plate accommodated within the crankcase and mounted on the drive shaft, a plurality of outlet ports communicating between respective ones of the cylinders and the discharging space, discharge valve means having a plurality of valve elements for closing and opening respective ones of the outlet ports, a fixing member securing the discharge valve means to the cylinder block at the one side thereof, the fixing member having a head formed at an end thereof facing the discharging space, and a front end opposite to the head, and capacity control means for changing pressure within the crankcase to thereby change the capacity or delivery quantity of the compressor, wherein the fixing member has a high pressure-introducing passage formed therethrough for introducing high-pressure refrigerant gas within the discharging space to the bearing-receiving hole, and then into the crankcase.

The variable capacity wobble plate compressor according to the invention is characterized in that the high pressure-introducing passage comprises a bore formed therein and extending from the head to the front end, and a restriction bore formed through the front end, the restriction bore opening into the bearing-receiving hole.

According to the compressor of the invention, in which the restriction bore opens into the bearing-receiving hole within the cylinder block, the high-pressure refrigerant gas from the discharging space undergoes adiabatic expansion upon entering bearing-receiving hole through the restriction bore, with the ratio of expansion (expressed as the inner diameter of the bearing-receiving hole/the inner diameter of the restriction bore) assuming a fairly large value since the former diameter is much larger than the latter diameter. As a result, the temperature of the high-pressure refrigerant gas from the discharging space is sufficiently lowered due to the adiabatic expansion taking place with such a large ratio of expansion, and thereafter introduced to the bearings within the bearing-receiving hole in the cylinder block. Therefore, the bearings in the bearing-receiving hole are more effectively cooled by the high-pressure refrigerant gas supplied from the discharging space, which results in prolonged lives of the bearings.

Further, since the restriction bore is formed through the front end of the fixing bolt, it is only required, when machining the high pressure-introducing passage through the fixing bolt 23, to perform a single step of boring the hole which extends from the head of the fixing member to the front end thereof. This results in a reduced number of machining steps as compared with the conventional compressor, and enables to reduce the manufacturing cost of the fixing member.

Further, since the bearings are more effectively cooled by the refrigerant gas supplied from the discharging space, and hence a smaller amount of the refrigerant gas is required to be introduced to the bearings, the inner diameter of the restriction bore can be reduced as desired so long as the building-up of the pressure within the crankcase by the blow-by gas is properly assisted by the high-pressure refrigerant gas supplied via the high pressure-introducing passage. This results in a reduced amount of high-pressure refrigerant gas leaking from the discharging space into the crankcase, so that the delivery quantity of the compressor is increased, enhancing the volumetric efficiency ($\eta v$) and coefficient of performance (COP), and hence improving the performance of the compressor.

The above and other objects, features, and advantages of the invention will become more apparent from the ensuing detailed description taken in conjunction with the accompanying drawings.

DETAILED DESCRIPTION

The invention will now be described in detail with reference to drawings showing a preferred embodiment thereof.

Figure 2:
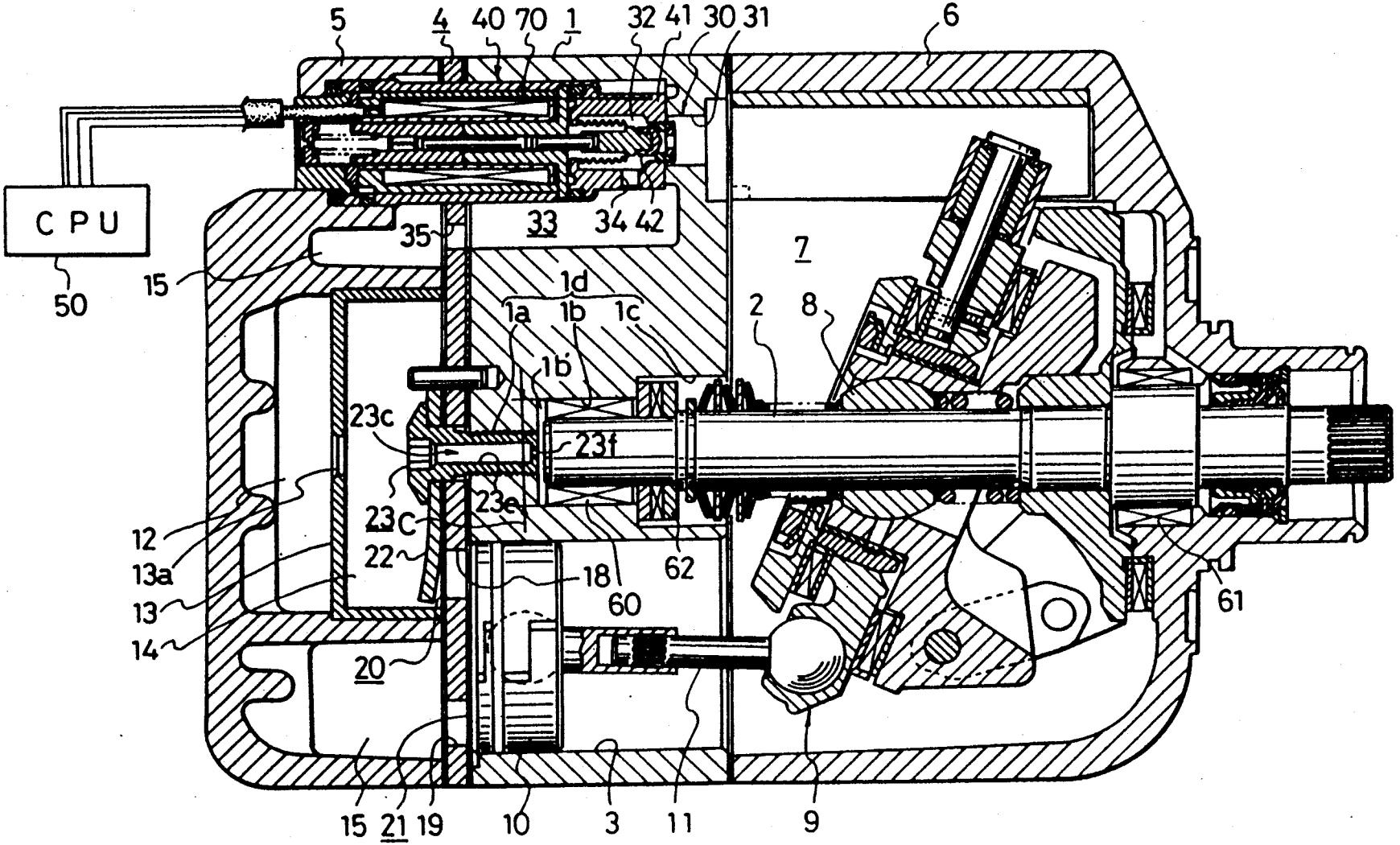
FIG. 2 is a longitudinal cross-sectional view of a variable capacity wobble plate compressor according to an embodiment of the invention.

Referring first to FIG. 2, there is shown a variable capacity wobble plate compressor according to an embodiment of the invention. In the figure, reference numeral 1 designates a cylinder block having a plurality of cylinders 3 formed therein at circumferentially regularly-spaced intervals such that they extend parallel to the axis of a drive shaft 2. A rear head 5 is fixed via a valve plate 4 to one end face of the cylinder block 1 in an airtight manner, and a front head 6 is fixed to the other end face of same in an airtight manner.

The drive shaft 2 has opposite ends thereof rotatably supported, respectively, by a radial bearing 60 within the cylinder block 1 and a radial bearing 61 within the front head 6. A driving force from an engine, not shown, is transmitted to the drive shaft 2 via an electromagnetic clutch and a pulley, neither of which is shown, mounted on a front head 6 side end of the drive shaft 2.

A crankcase 7 is defined within the interior of the front head 6. Accommodated within the crankcase 7 is a wobble plate 9 which is linked to the drive shaft 2 for making a rocking motion around a hinge ball 8 slidably fitted on the drive shaft 2, in opposite directions along the axis of the drive shaft 2. Pistons 10 are slidably inserted in the cylinders 10 and linked via respective rods 11 to the wobble plate 9, so that the pistons 10 are sequentially reciprocated according to the rocking motion of the wobble plate 9. Further, the wobble plate 9 is supported around the hinge ball 8 in such a manner that the inclination angle of the wobble plate 9 (the angle formed between the wobble plate and a line perpendicular to the axis of the drive shaft 2) increases as the pressure within the crankcase 7 decreases, whereas the former decreases as the latter increases. Further, the capacity or delivery quantity of the compressor increases with an increase in the inclination angle of the wobble plate 9, since the increase in the inclination angle increases the stroke of the pistons 10, whereas the capacity decreases with a decrease in the inclination angle of same, since the decrease in the inclination angle decreases the stroke of the pistons 10.

Defined within the rear head 5 are a discharge pressure chamber 12, a discharging space 14 which communicates with the discharge pressure chamber 12 via a central hole **13*a* formed through a partition wall 13, and a suction chamber 15 in an annular form defined around these. The discharge pressure chamber 12 communicates via a discharge port thereof, not shown, with the inlet of a condenser of an air-conditioner, not shown, while the suction chamber 15** communicates, via a suction port thereof, not shown, with the outlet of an evaporator.

The valve plate 4 is formed therein at circumferetially-spaced locations with a plurality of outlet ports 18 communicating the respective cylinders 3 with the discharging space 14, and a plurality of inlet ports 19 communicating the respective cylinders 3 with the suction chamber 15. Arranged on a rear head side 5 end face of the valve plate 4 is discharge valve means 20 having a plurality of discharge valve elements for closing and opening the respective outlet ports 18 independently of each other. Arranged on a cylinder block 1 side end face of the valve plate 4 is inlet valve means 21 having a plurality of inlet valve elements for closing and opening the respective inlet ports 19 independently of each other. A central portion of the discharge valve means 20 is fixed to the valve plate 4 together with a valve retainer 22 by means of a fixing bolt 23 (fixing member), which is screwed into a threaded hole **1*a* formed in the cylinder block 1**.

A communicating hole **1*d* is formed through a central portion of the cylinder block 1, which hole is formed by the threaded hole 1*a*, a medium diameter hole 1*b* (part of a bearing-receiving hole) having an inner diameter C (e.g. C=19 mm), and an increased-diameter hole (part of the bearing-receiving hole). The medium diameter hole 1b has a radial bearing 60 received therein, and the increased-diameter hole 1c has a thrust bearing 62 received therein. The radial bearing 60 is arranged within the medium diameter hole 1b in such a manner that a space 1b' is formed on the left end side of the radial bearing 60, as viewed in FIG. 2**.

Figure 3:
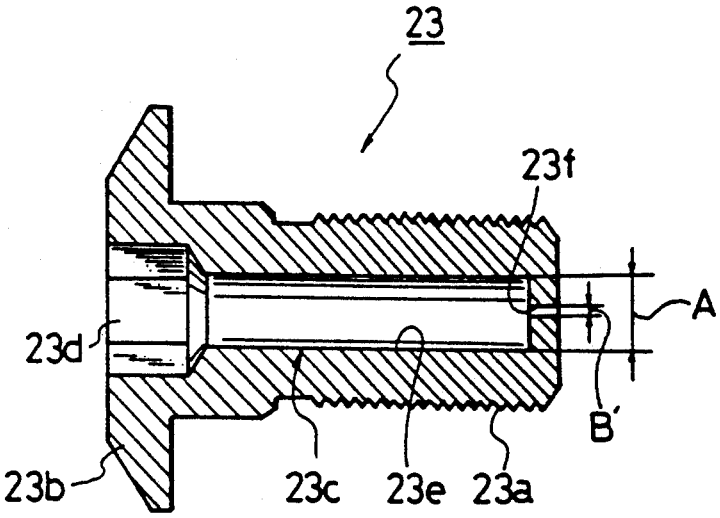
FIG. 3 is an enlarged cross-sectional view of a fixing bolt appearing in FIG. 2.

As shown in FIGS. 2 and 3, the fixing bolt 23 has an external threaded portion 23a engaged in the threaded hole 1a of the cylinder block, and a dish-shaped head 23b. Further, the fixing bolt 23 is formed therethrough with a high pressure-introducing passage 23c for introducing high-pressure refrigerant gas from the discharging space 14 (and hence from the discharge pressure chamber 12) to the radial bearing 60 in the cylinder block 1.

The high pressure-introducing passage 23c consists of a hexagon socket 23d formed in a central portion of the head 23b for receiving an end of a hexagonal wrench key, a bore 23e having an inner diameter A (e.g. A=3 mm) and extending continuously from the hexagon socket 23d to a depth near the front end of the fixing bolt 23, and a restriction bore 23f extending through a front end wall of the fixing bolt 23 and having an inner diameter B' (e.g. B'=0.3 mm). The restriction bore 23f opens into the above-mentioned space 1b' in the bearing-receiving hole 1b in the cylinder block 1.

Further, the compressor is provided with capacity control means 40 disposed to open and close a communicating passage 30 communicating the crankcase 7 with the suction chamber 15 to thereby vary the capacity or delivery quantity of the compressor.

The communicating passage 30 consists of a high-pressure side passage 31 formed in the cylinder block 1 and opening into the crankcase 7, a high-pressure side space 32 defined within a casing 41 of the capacity control means 40, a communicating hole 34 formed through the casing 41 and communicating the low-pressure side space 32 with a low-pressure side space 33 defined within the cylinder block 1, and a communicating hole 35 formed through the valve plate 4 and communicating the low-pressure side space 33 with the suction chamber 15.

The capacity control means 40 extends through the major length of the rear head 5, the valve plate 4 and the cylinder block 1. Further, the capacity control means 40 comprises a valve element 42 for adjusting the communication between the high-pressure side passage 31 and the low-pressure side passage 33, and a solenoid actuator 70 for attracting the valve element 42 in a valve-closing direction in response to a control signal from a CPU 50 located outside the compressor.

Next, the operation of the variable capacity wobble plate compressor constructed as above will be described.

When a driving force from an engine installed on an automotive vehicle is transmitted to the drive shaft 2, the wobble plate 9 which is interlocked to the drive shaft 2, makes a rocking motion along the axis of the drive shaft 2 as the drive shaft 2 rotates. The rocking motion of the wobble plate 9 causes the pistons 10 to be sequentially reciprocated in the cylinders 3, to change the volumes of the compression chambers of the cylinders, whereby refrigerant gas is drawn into the cylinders, compressed, and discharged therefrom. Thus, the high-pressure refrigerant gas is delivered from the compressor in an amount commensurate to the inclination angle of the wobble plate 9.

More specifically, when the thermal load on the compressor decreases to cause the capacity control means 40 to close the communicating passage 30, the pressure within the crankcase 7 is inhibited from leaking into the suction chamber 15 so that the above-mentioned blow-by gas accumulates within the crankcase 7 to increase the pressure within the crankcase 7. As the pressure within the crankcase 7 thus increases, the inclination angle of the wobble plate 9 decreases and accordingly shortens the stroke of the pistons 10 to thereby decrease the capacity or delivery quantity of the compressor. On the other hand, the high-pressure refrigerant gas within the discharging space 14 is constantly introduced through the high pressure-introducing passage 23c formed through the fixing bolt 23 to the bearing-receiving hole 1b, and further via the bearing-receiving hole 1c into the crankcase 7. This assists building-up of the pressure within the crankcase by the blow-by gas, which enables to more effectively increase the pressure within the crankcase, which results in improved controllability of the compressor capacity.

When the thermal load increases to cause the capacity control means 40 to open the communicating passage 30, the pressure within the crankcase 7 is allowed to leak into the suction chamber 15 so that the pressure within the crankcase 7 decreases. As the pressure within the crankcase 7 thus decreases, the inclination angle of the wobble plate 9 increases and accordingly lengthens the stroke of the pistons 10 to thereby increase the capacity or delivery quantity of the compressor.

Further, in the variable capacity wobble plate compressor according to the present embodiment, the restriction bore 23f of the high pressure-introducing passage 23c formed through the fixing bolt 23 is located at the front end of the fixing bolt 23 and opens into the space 1b' in the bearing-receiving hole 1b within the cylinder block 1. Therefore, when the high-pressure refrigerant gas from the discharging space 14 passes through the restriction bore 23f of the high pressure-introducing passage 23c into the space 1b' in the bearing-receiving hole 1b, it undergoes adiabatic expansion with a ratio of expansion which is far greater than that (approx. 7.5) attained in the conventional variable capacity wobble plate compressor. The ratio of expansion is expressed as "the inner diameter C of the bearing-receiving hole 1b/the inner diameter B' of the restriction bore 23f". If C=19 mm and B'=0.3 mm, for example, the ratio of expansion assumes a fairly large value of 63.3. As a result, the temperature of the high-pressure refrigerant gas from the discharging space 14 is sufficiently lowered through the adiabatic expansion taking place with the large ratio of expansion, to be subsequently supplied to the radial bearing 60 and the thrust bearing 62. Therefore, the radial bearing 60 and the thrust bearing 62 are more effectively cooled by the refrigerant gas supplied from the discharging space 14 than in the case of the conventional compressor, which results in prolonged lives of the bearings 60, 62.

Further, since the restriction bore 23f is formed through the front end of the fixing bolt 23, it is only required, when machining the high pressure-introducing passage 23c through the fixing bolt 23, to perform a single step of boring the hole 23e which is continuous with the hexagon socket 23d and having the inner diameter A (e.g. A=3 mm) to the depth close to the front end of the fixing bolt 23. This results in a reduced number of machining steps as compared with the conventional compressor, and enables to reduce the manufacturing cost of the fixing bolt 23.

Figure 1:
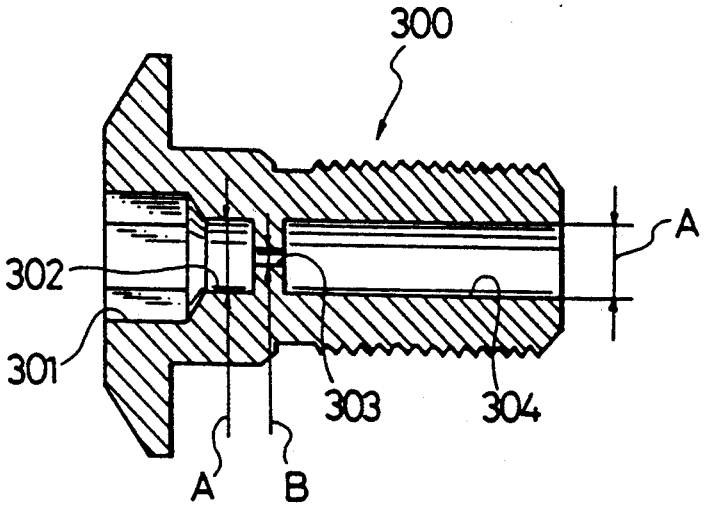
FIG.1 PRIOR ART
FIG. 1 is a longitudinal cross-sectional view of a fixing bolt used in a conventional variable capacity wobble plate compressor.

Further, since the bearings 60, 62 are more effectively cooled by the refrigerant gas supplied from the discharging space 14, and hence a smaller amount of the refrigerant gas is required to be introduced to the bearings, the inner diameter of the restriction bore 23*f* can be reduced as desired so long as the building-up of the pressure within the crankcase by the blow-by gas is properly assisted by the high-pressure refrigerant gas supplied via the high pressure-introducing passage 23*c*. More specifically, in the case of the prior art shown in FIG. 1, the restriction bore 303 is required to have the inner diameter B of approx. 0.4 mm, whereas according to the present embodiment, the inner diameter B′ of the restriction bore 23*f* can be reduced to approx. 0.3 mm. This results in a reduced amount of high-pressure refrigerant gas leaking from the discharging space 14 into the crankcase 7, so that the delivery quantity of the compressor is increased, leading to enhanced volumetric efficiency ($\eta v$) and enhanced coefficient of performance (COP), and hence improved performance of the compressor.

What is claimed is:

1. In a variable capacity wobble plate compressor including a cylinder block, said cylinder block having a plurality of cylinders formed therein and a bearing-receiving hole formed therethrough, bearings received within said bearing-receiving hole, a discharging space defined on one side of said cylinder block, a crankcase defined on the other side of said cylinder block, a drive shaft having one end thereof supported by said bearings within said bearing-receiving hole, a wobble plate accommodated within said crankcase and mounted on said drive shaft, a plurality of outlet ports communicating between respective ones of said cylinders and said discharging space, discharge valve means having a plurality of valve elements for closing and opening respective ones of said outlet ports, a fixing member securing said discharge valve means to said cylinder block at said one side thereof, said fixing member having a head formed at an end thereof facing said discharging space, and a front end opposite to said head, and capacity control means for changing pressure within said crankcase to thereby change the capacity or delivery quantity of said compressor, wherein said fixing member has a high pressure-introducing passage formed therethrough for introducing high-pressure refrigerant gas within said discharging space to said bearing-receiving hole, and then into said crankcase, the improvement wherein said high pressure-introducing passage comprises a bore formed therein and extending from said head to said front end, and a restriction bore formed through said front end, said restriction bore opening into said bearing-receiving hole.

2. A variable capacity wobble plate compressor according to claim 1, wherein said bearings and said one end of said drive shaft are arranged within said bearing-receiving hole such that end faces of one of said bearings and said end of said drive shaft are spaced from said front end of said fixing member, whereby said restriction bore opens into a space formed between said end faces of said one of said bearings and said end of said drive shaft and said front end of said fixing member.

* * * * *